US011084646B1

(12) United States Patent
Hwang et al.

(10) Patent No.: US 11,084,646 B1
(45) Date of Patent: Aug. 10, 2021

(54) REFILLABLE PUMP DISPENSER

(71) Applicant: Crystal International (Group) Inc.

(72) Inventors: Roger Hwang, Maple (CA); Stephen M Fisher, II, Sherman, CT (US); William Lloyd Alusitz, Yorktown Heights, NY (US)

(73) Assignee: CRYSTAL INTERNATIONAL (GROUP), Scarborough (CA)

( * ) Notice: Subject to any disclaimer, the term of this patent is extended or adjusted under 35 U.S.C. 154(b) by 0 days.

(21) Appl. No.: 16/825,443

(22) Filed: Mar. 20, 2020

(51) Int. Cl.

| | |
|---|---|
| ***B05B 11/00*** | (2006.01) |
| ***B65D 83/00*** | (2006.01) |
| ***B65D 47/24*** | (2006.01) |
| ***A45D 34/00*** | (2006.01) |

(52) U.S. Cl.
CPC ..... *B65D 83/0033* (2013.01); *A45D 34/00* (2013.01); *B65D 47/243* (2013.01); *A45D 2200/056* (2013.01)

(58) Field of Classification Search
CPC ..... B05B 11/3059; B05B 11/0027; B05B 11/3008; B05B 11/0037; B05B 11/00416; B05B 11/02; B05B 11/06; B05B 11/061; B05B 11/3052; B05B 11/3056; B05B 11/0059; B05B 11/3005; B65D 2215/04; B65D 83/205; B65D 83/22; B65D 83/20; B65D 83/56
USPC ..... 222/321.8, 321.7, 401, 505, 309, 402.11, 222/153.13, 384, 402.13, 321.9
See application file for complete search history.

(56) References Cited

U.S. PATENT DOCUMENTS

| | | | | |
|---|---|---|---|---|
| 3,268,123 | A | 8/1966 | Spatz | |
| 4,065,036 | A * | 12/1977 | Kirk, Jr. | B05B 11/3059 222/153.13 |
| 4,511,068 | A | 4/1985 | Bossina | |
| 4,889,262 | A * | 12/1989 | Toms | B05B 11/3059 222/153.13 |
| 5,139,168 | A | 8/1992 | Gueret | |
| 7,874,461 | B2 * | 1/2011 | Bae | B05B 11/3067 222/153.13 |
| 8,308,029 | B2 * | 11/2012 | Ki | B05B 11/0027 222/309 |
| D714,160 | S * | 9/2014 | Park | D9/688 |
| 9,010,581 | B2 * | 4/2015 | Presche | B05B 11/3074 222/153.13 |
| 10,752,412 | B1 * | 8/2020 | Hawry | B05B 11/3059 |
| 2009/0302062 | A1 * | 12/2009 | Maddy | B05B 11/3059 222/183 |
| 2010/0051649 | A1 * | 3/2010 | Ki | B05B 11/3059 222/256 |

(Continued)

*Primary Examiner* — Charles P. Cheyney
(74) *Attorney, Agent, or Firm* — Patterson + Sheridan, LLP

(57) ABSTRACT

A refillable pump dispenser comprising an outer container formed at an upper portion thereof with an entrance, an inner container inserted into the outer container for accommodating a cosmetic product in the inner container; a pushing plate inserted into an inner lower side of the inner container to push up the cosmetic product; and a dispenser head assembly removably coupled with upper sides of both the outer container and the inner container so that the outer container and the dispenser head assembly can be reused while the inner container can be replaced or refilled when the cosmetic product accommodated inside the inner container has been completely exhausted.

19 Claims, 5 Drawing Sheets

(56) References Cited

U.S. PATENT DOCUMENTS

| | | | | |
|---|---|---|---|---|
| 2013/0026186 | A1* | 1/2013 | Jenkins | B05B 11/3025 222/153.13 |
| 2015/0239643 | A1* | 8/2015 | Kim | B65D 83/222 222/153.14 |
| 2018/0290161 | A1* | 10/2018 | Lee | B05B 11/00416 |

* cited by examiner

REFILLABLE PUMP DISPENSER

BACKGROUND

Field of the Invention

The present disclosure relates to a refillable pump dispenser, especially for a flowable cosmetic product.

Description of the Related Art

Refillable dispensers provide one answer to our environmental concern over garbage disposal. Containers which would normally be trashed, or at best partially recycled, can with a refill concept be reused numerous times. This represents the most convenient way for consumers to help reduce landfill waste. Moreover, recycling costs are lowered with respect to collecting, storing and disposing of plastic containers.

Pump dispensers are convenient packages for delivering viscous flowable materials. Consumer products such as toothpaste have, for several years, been sold to some extent in pumps. These type of containers are, however, quite expensive. Typical of the art are those described in U.S. Pat. No. 3,268,123 (Spatz) and U.S. Pat. No. 4,511,068 (Bossina) which depend upon a one-way movable, spring-like diaphragm.

Environmental regulations are being considered concerning source reduction for packaging. Not only must the amount of packaging be reduced, but the type must be simplified for recycling purposes.

The known pump dispensers still have one environmental problem which requires improvement. Simple pump dispensers up until now have not been refillable. Not only must the upper material-containing body but also the lower piston body be discarded upon exhaustion of the material to be dispensed.

A popular approach to the refill concept has been assemblies in which the product to be dispensed is contained within a flexible pouch for example as described in U.S. Pat. No. 5,139,168 (Gueret).

There exists a need for a simple pump dispenser wherein more components of the pump dispenser could be reused thereby reducing the disposable amount of packaging.

SUMMARY

Accordingly, it is an object of the present disclosure to provide a simple displacement pump capable, at least in part, of being reusable.

Accordingly, it is an object of the present disclosure to provide a simple pump dispenser requiring only one component to be replaced and rest of the components of the pump dispenser could be reused thereby reducing the disposable amount of packaging.

Yet another object of the present disclosure is to provide a refillable pump dispenser capable of receiving a refill container which can be quickly and easily loaded into the dispenser without mixing, pouring, spillage or messiness.

Still another object of the present disclosure is to provide a refill container suitable for a refillable pump dispenser having a mechanism allowing a consumer to easily attach/detach the refill container.

According to an embodiment of the present disclosure, a refillable pump dispenser for a flowable cosmetic product comprises an outer container formed at an upper portion thereof with an entrance, an inner container inserted into the outer container for accommodating a cosmetic product in the inner container; a pushing plate inserted into an inner lower side of the inner container to push up the cosmetic product; and a dispenser head assembly coupled with the upper sides of both the outer container and the inner container.

Both the outer container and the inner container are detachably connected to the dispenser head assembly so that the outer container and the dispenser head assembly can be reused while the inner container can be replaced or refilled when the cosmetic product accommodated inside the inner container has been completely exhausted.

According to an embodiment of the present disclosure, the dispenser head assembly includes a cap, a pump assembly, a pressing member and an annular sleeve.

According to an embodiment of the present disclosure, the annular sleeve and the pressing member are inserted inside the cap. Further, the cap includes a cylindrical body having open top and bottom ends and the cylindrical body formed at one side thereof with an outlet revealing hole.

According to an embodiment of the present disclosure, the pressing member is coupled to an upper portion of the pump assembly and formed at one side thereof with an outlet through which the pumped cosmetic product is discharged. The pressing member is oriented such that the outlet thereof protrudes out from the outlet revealing hole of the cap.

According to an embodiment of the present disclosure, the cap is coupled to the upper portion of the outer container in a removable manner. More particularly, the outer container is formed in a cylindrical shape, and formed at an upper portion thereof with the entrance. At least one groove is formed on an outer periphery of the entrance which is coupled with at least one protrusion formed at an inner surface of a lower end portion of the cylindrical body of the cap. In present embodiment, the at least one groove of the outer container is L or J shaped in which the at least one protrusion of the cap is engaged, thereby connecting the cap and the lower container by a J-lock which is easily connected and disconnected. In other embodiments, any other engagement means capable of removably coupling the cap and the outer container may be used for e.g. snap fitment, threaded engagement, magnetic engagement etc.

According to an embodiment of the present disclosure, the annular sleeve of the dispenser head assembly is fixedly coupled to the cap and comprises at one coupling protrusion on an outer surface thereof which couples with corresponding coupling groove formed on the inner surface of the cap. In other alternate embodiment, the annular sleeve may comprise at least one coupling groove on an outer surface thereof which couples with corresponding coupling protrusion formed on the inner surface of the cap.

According to an embodiment of the present disclosure, the annular sleeve of the dispenser head assembly is removably connected with the inner container. The annular sleeve of the dispenser head assembly and the inner container may, for example, be engaged with each other through interengageable threads which is a removable engagement so that the inner container could be replaced when the cosmetic product is exhausted. Thus the inner container is replaceable. In the present embodiment, the annular sleeve comprises a central bore and an inner surface of the central bore comprises threads that engage with corresponding threads formed on an outer surface of a neck of the inner container. In other embodiments, any other engagement means capable of removably coupling the annular sleeve and the inner container may be used for e.g. snap fitment, j-lock, magnetic engagement etc.

According to an embodiment of the present disclosure, the annular sleeve is also designed to fasten or retain the pump assembly stably to the neck of the inner container. The pump assembly is installed through the central bore of the annular sleeve.

According to an embodiment of the present disclosure, the pump assembly comprises a cup shaped body, a hollow elongated stem, a spring, an annular fluid tight piston, a retaining element, and a check valve. The check valve is a one way valve.

The pump assembly is designed to be fastened to the mouth of the inner container containing said cosmetic product. The pump assembly comprises the cup-shaped body delimiting a chamber for suction/compression of the cosmetic product to be dispensed and in which the hollow stem extends at least partially.

The chamber is delimited by a wall of the cup-shaped body; a one-way valve, designed to close a hole for inlet of the cosmetic product to be dispensed into said chamber from the inner container; the annular piston; and a widened end portion of the stem.

The cup shaped body comprises an outer flange which is received in an inner groove present in the central bore of the annular sleeve for fixedly receiving the pump assembly in the central bore of the annular sleeve.

The annular piston is slidable in a fluid-tight way on an inner surface of the chamber and on a lower end of the hollow stem.

The spring has a top end which bears upon a projecting collar of the stem, which is made of a single piece with the stem at an upper end portion of said stem.

The retaining element retains a bottom end of said spring. The retaining element has a cylindrical shaped body having an outer portion that is fastened to the cup-shaped body at an inner stepped portion of the cup shaped body.

According to an embodiment of the present disclosure, the annular piston being mobile between a first position and at least a second position, wherein in the first position the pressing member is in a non-pressed state and wherein in the second position, the pressing member is in a pressed state.

In the first position, when the pressing member is not pressed, the annular piston closes in a fluid-tight way, under the thrust of said spring, at least one hole that traverses the thickness of the stem in proximity of its first end and opens into a cavity of the stem. More particularly, said piston bears in a fluid-tight way upon a widened end portion of the stem and closes said cavity of the stem and blocks the connection between said chamber and the cavity of the stem itself.

In the second position, when the pressing member is pressed, the spring is compressed and the piston is raised away from said at least one hole of the stem and from said widened end portion, enabling the cosmetic product present in the chamber to be dispensed by passing through said hole and cavity made in the stem.

Preferably, the stem comprises at least one first hollow tubular element and one second hollow tubular element, which are partially inserted into one another and have features for e.g. corresponding groove and protrusion designed to fasten them together. The first tubular element extends at least partially on the outside of the cup-shaped body and has the collar for retaining the first end of the spring. The second tubular element presents the inlet hole of the cavity of the stem and also comprises the widened end portion for resting of the piston.

Further, the pump assembly comprises a ring disposed at least partially within a top part of the cup shaped body. The ring has at least a protrusion on its outer surface that snap fits with a corresponding inner groove formed at the top part of the cup shaped body. The ring having an inwardly projecting rim for retention of the collar of the stem, which is designed to prevent exit of the stem from the cup shaped body under the thrust of the spring.

The first hollow tubular element of the stem has, at its top mouth an annular groove for snap coupling with the pressing member.

The spring, the piston, and the retaining element have a through hole so that they can be fitted on the stem.

Additionally, the inner container may not be made in a single piece and may comprise a tubular body whose lower end is closed by a separate bottom plate.

In order to assemble the refillable dispenser pump, the pushing plate is inserted into the inner container, the cosmetic material is accommodated therein, and then the inner container is coupled to the annular sleeve of the dispenser head assembly through corresponding screw means, the outer container is then coupled with the lower end portion of the cap of the dispenser head assembly using J-lock means such that inner container is received into the outer container.

In order to use the cosmetic container assembled in the above manner, the outer container is held by one hand, the pressing member is pressed so that it moves downward to actuate the pump assembly, and thus the cosmetic product is discharged to the outlet for use.

It is advantageous that the components of the refillable pump dispenser are produceable from plastic material through injection molding and the provided safety measures or stroke settings as a matter of principle do not require any additional components but can be configured at the existing basic components. This yields a configuration which is also advantageous for a mass production of the refillable pump dispensers. Simultaneously a simple assembly of the components forming the refillable pump dispenser is provided.

The above and other objects, features and advantages of the present disclosure will become clear from the following description of the preferred embodiments when the same is read in conjunction with the accompanying drawings.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings.

Figure 1:
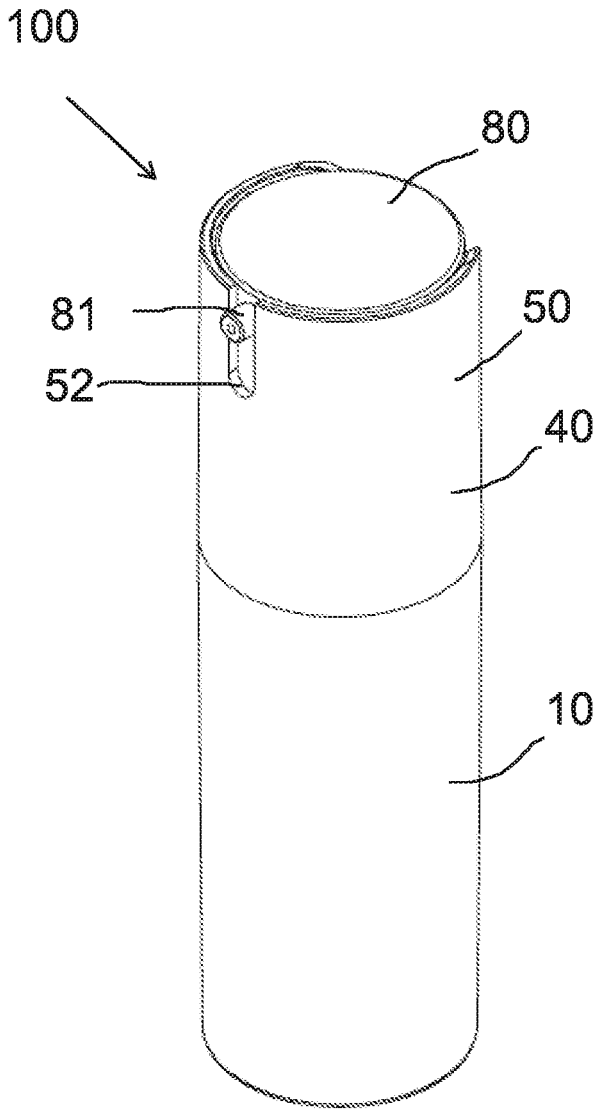
FIG. 1 shows a perspective view of a refillable pump dispenser according to present disclosure.

To facilitate understanding, identical reference numerals have been used, where possible, to designate identical elements that are common to the figures. It is to be noted, however, that the appended drawings illustrate only typical embodiments of this disclosure and are therefore not to be considered limiting of its scope, for the disclosure may admit to other equally effective embodiments.

DETAILED DESCRIPTION

Throughout this specification, the terms "comprise," "comprises," "comprising" and the like, shall consistently mean that a collection of objects is not limited to those objects specifically recited.

Figure 2:
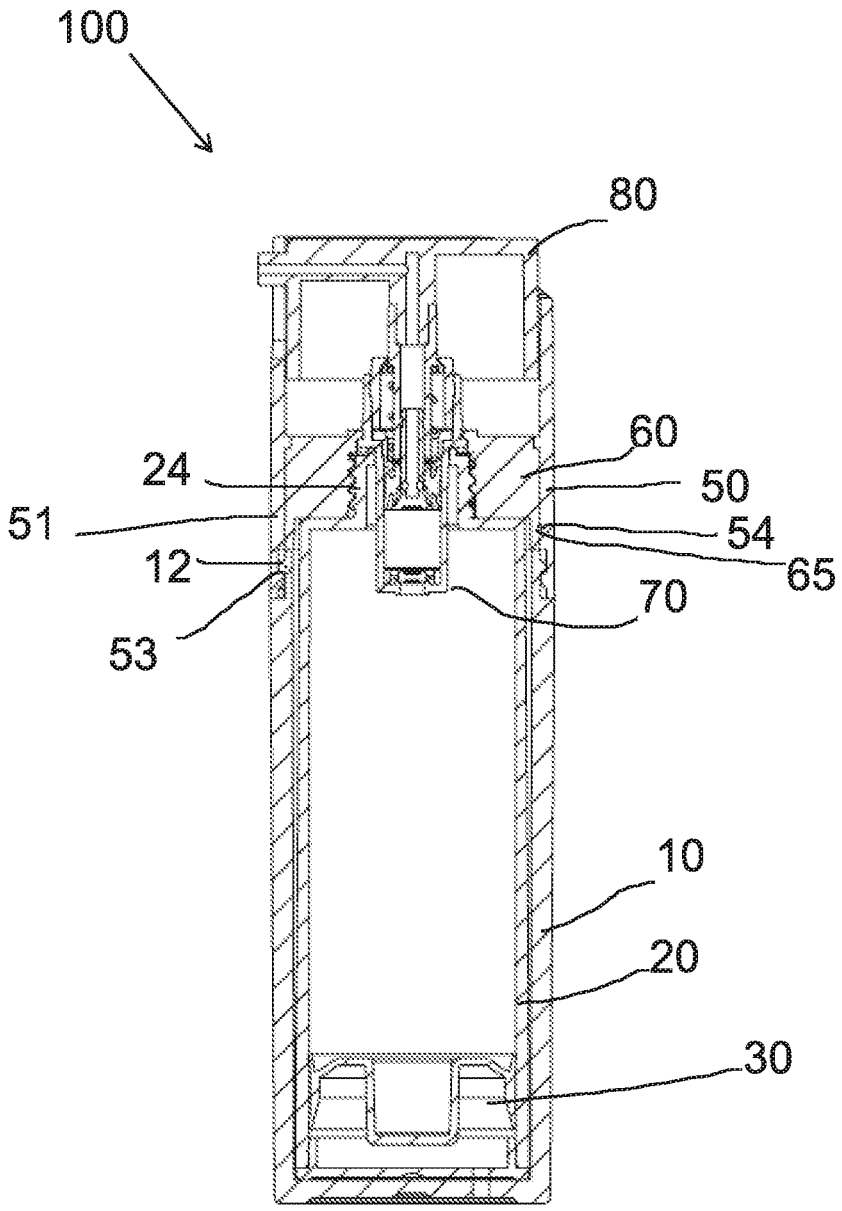
FIG. 2 shows a sectional view of the refillable pump dispenser of FIG. 1.
Figure 3:
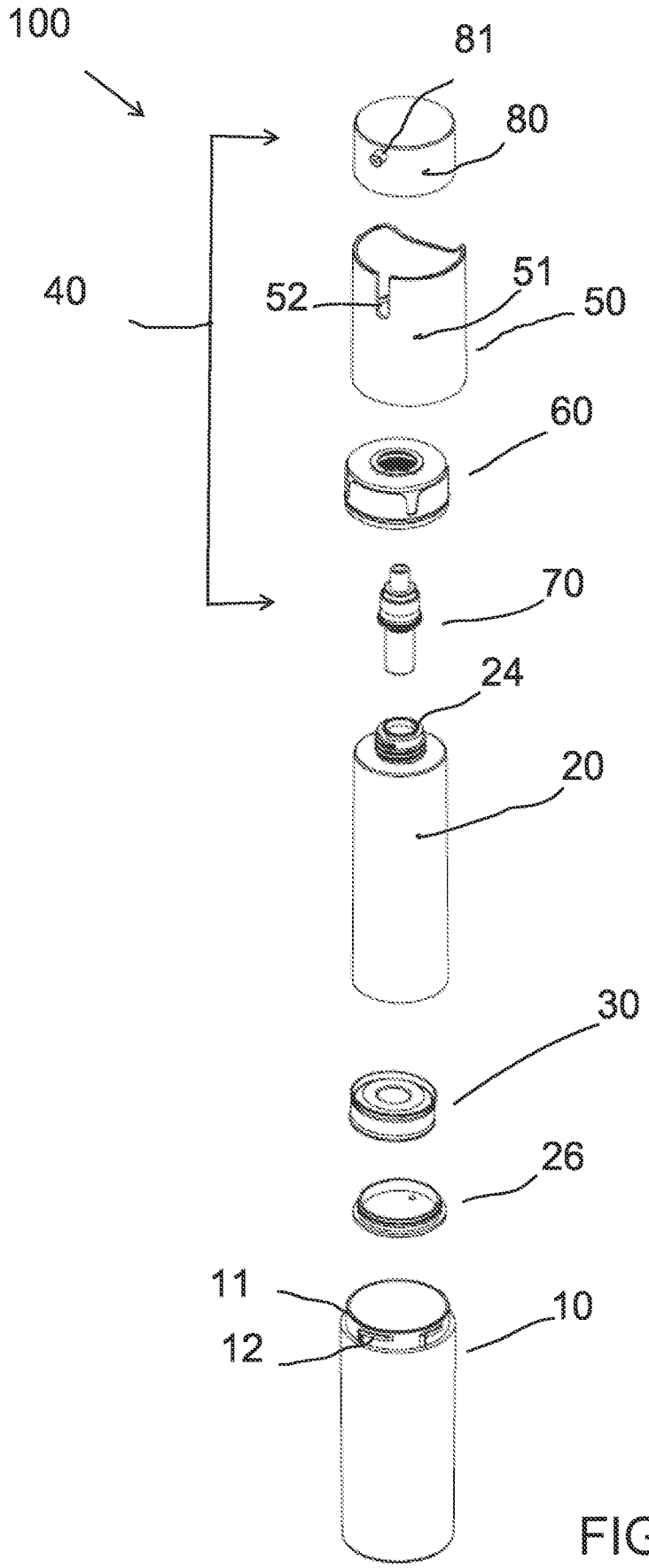
FIG. 3 shows an exploded view of the refillable pump dispenser of FIG. 1.
Figure 4:
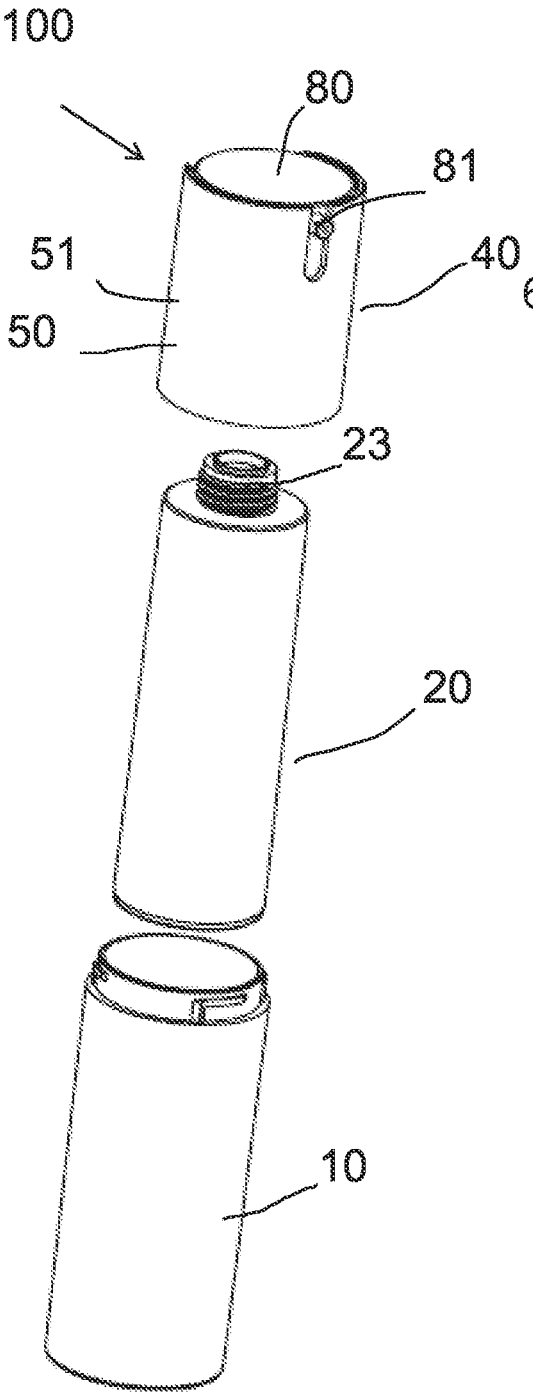
FIG. 4 shows another exploded view of the refillable pump dispenser of FIG. 1, wherein a dispenser head assembly of the refillable pump dispenser is not in exploded state.

According to the present disclosure and as shown in FIGS. 1-3, the refillable pump dispenser 100 comprises an outer container 10 formed at an upper portion thereof with an entrance 11, an inner container 20 inserted into the outer container 10 for accommodating a cosmetic product in the inner container 20; a pushing plate 30 inserted into an inner lower side of the inner container 20 to push up the cosmetic product; and a dispenser head assembly 40 coupled with the upper sides of both the outer container 10 and the inner container 20.

Both the outer container 10 and the inner container 20 are detachably connected to the dispenser head assembly 40 so that the outer container 10 and the dispenser head assembly 40 can be reused while the inner container 20 can be replaced or refilled when the cosmetic product accommodated inside the inner container 20 has been completely exhausted.

As shown in FIGS. 2 to 5, the dispenser head assembly 40 includes a cap 50, a pump assembly 70, a pressing member 80 and an annular sleeve 60.

The annular sleeve 60 and the pressing member 80 are inserted inside the cap 50. Further, the cap 50 includes a cylindrical body 51 having open top and bottom ends and the cylindrical body 51 formed at one side thereof with an outlet revealing hole 52.

The pressing member 80 is coupled to an upper portion of the pump assembly 70 and formed at one side thereof with an outlet 81 through which the pumped cosmetic product is discharged. The pressing member 80 is oriented such that the outlet 81 thereof protrudes out from the outlet revealing hole 52 of the cap 50, as seen in FIG. 1.

As shown in FIGS. 2-3, the cap 50 is coupled to the upper portion of the outer container 10 in a removable manner. More particularly, the outer container 10 is formed in a cylindrical shape, and formed at an upper portion thereof with the entrance 11. At least one groove 12 is formed on an outer periphery of the entrance 11, the at least one groove 12 is coupled to at least one protrusion 53 formed at an inner surface of a lower end portion of the cylindrical body 51 of the cap 50. In present embodiment, the at least one groove 12 of the outer container 10 is L or J shaped in which the at least one protrusion 53 of the cap 50 is engaged, thereby connecting the cap 50 and the lower container 10 by a J-lock which is easily connected and disconnected. In other embodiments, any other engagement means capable of removably coupling the cap 50 and the outer container 10 may be used for e.g. snap fitment, threaded engagement, magnetic engagement etc.

The annular sleeve 60 of the dispenser head assembly 40 is fixedly coupled to the cap 50 and comprises at one coupling protrusion 65 on an outer surface thereof which couples with corresponding coupling groove 54 formed on the inner surface of the cap 50, as shown in FIG. 2. In other alternate embodiment, the annular sleeve 60 may comprise at least one coupling groove on an outer surface thereof which couples with corresponding coupling protrusion formed on the inner surface of the cap 50.

Figure 5:
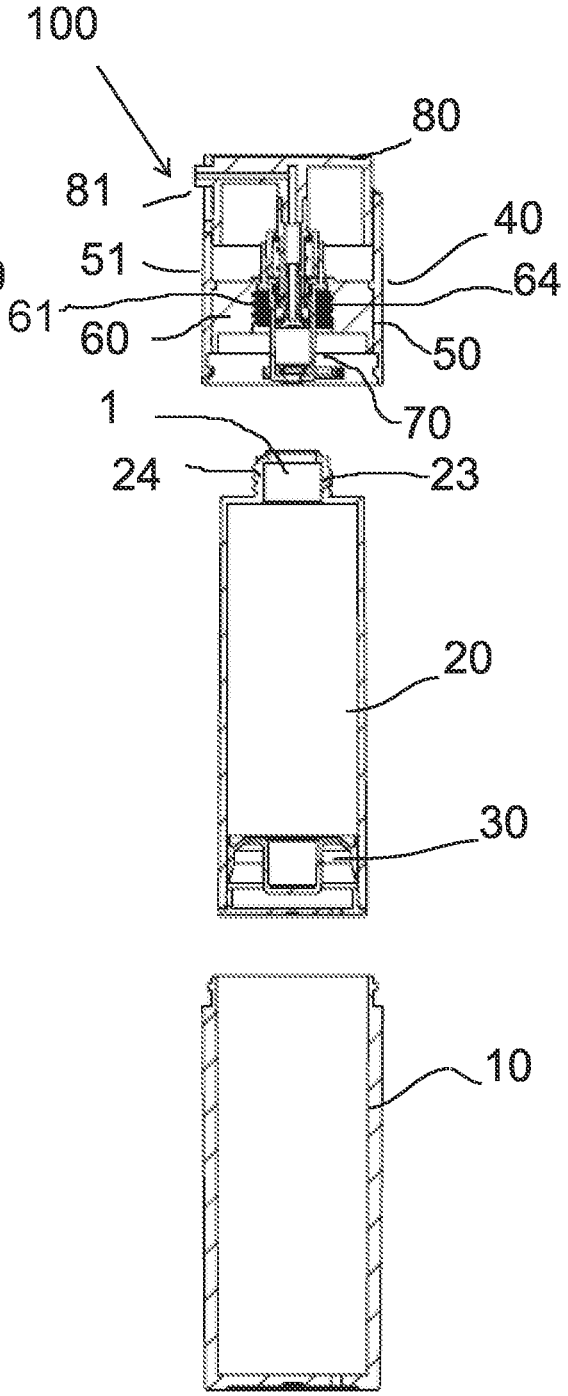
FIG. 5 shows a front cross sectional view of the refillable pump dispenser of FIG. 4.

The annular sleeve 60 of the dispenser head assembly 40 is removably connected with the inner container 20. The annular sleeve 60 of the dispenser head assembly 40 and the inner container 20 may, for example, be engaged with each other through inter-engageable threads which is a removable engagement so that the inner container 20 could be replaced when the cosmetic product is exhausted. Thus the inner container 20 is replaceable. In the present embodiment, the annular sleeve 60 comprises a central bore 64 and an inner surface of the central bore 64 comprises threads 61 that engage with corresponding threads 23 formed on an outer surface of a neck 24 of the inner container 20, as shown in FIG. 5. In other embodiments, any other engagement means capable of removably coupling the annular sleeve 60 and the inner container 20 may be used for e.g. snap fitment, j-lock, magnetic engagement etc.

Further, the annular sleeve 60 is also designed to fasten or retain the pump assembly 70 stably to the neck 24 of the inner container 20. The pump assembly 70 is installed through the central bore 64 of the annular sleeve 60.

Figure 6:
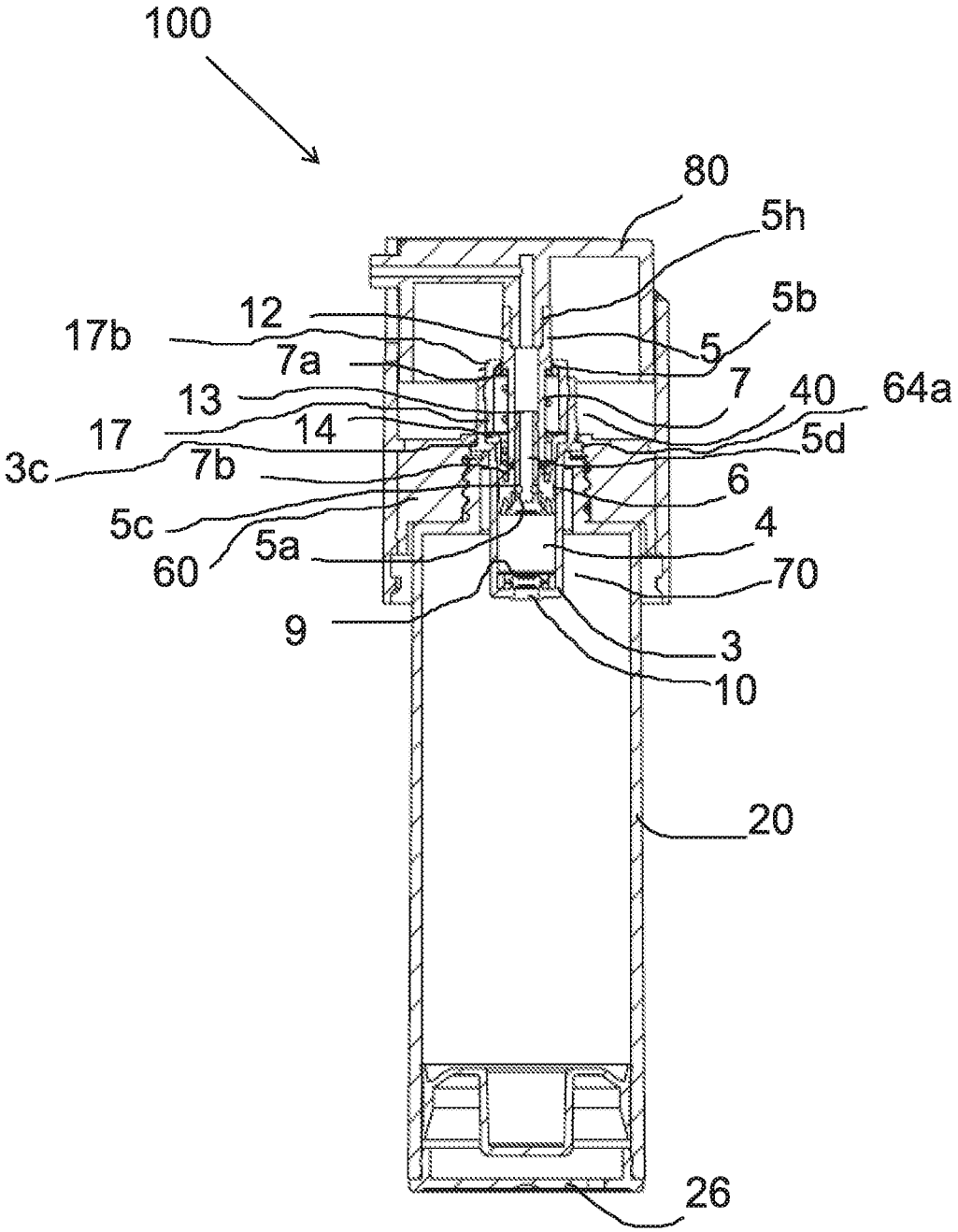
FIG. 6 shows a cross sectional view of the refillable pump dispenser of FIG. 1 with an outer container thereof removed.

Further, as shown in FIG. 6, the pump assembly 70 comprises a cup shaped body 3, a hollow elongated stem 5, a spring 7, an annular fluid tight piston 6, a retaining element 14, and a check valve 9 which is a one way valve.

The pump assembly 70 is designed to be fastened to the mouth 1 of the inner container 20 containing said cosmetic product. The pump assembly 70 comprises the cup-shaped body 3 delimiting a chamber 4 for suction/compression of the cosmetic product to be dispensed and in which the hollow stem 5 extends at least partially.

The chamber 4 is delimited by a wall of the cup-shaped body 3; a one-way valve 9, designed to close a hole 10 for inlet of the cosmetic product to be dispensed into said chamber 4 from the inner container 20; the annular piston 6; and a widened end portion 5*a* of the stem 5.

The cup shaped body 3 comprises an outer flange 3*c* which is received in an inner groove 64*a* present in the central bore 64 of the annular sleeve 60 for fixedly receiving the pump assembly 70 in the central bore 64 of the annular sleeve 60.

The annular piston 6 is slidable in a fluid-tight way on an inner surface of the chamber 4, and on a lower end of the hollow stem 5.

The spring 7 has a top end 7*a* which bears upon a projecting collar 5*b* of the stem 5, which is made of a single piece with the stem 5 at an upper end portion of said stem 5.

The retaining element 14 retains a bottom end 7*b* of said spring 7. The retaining element 14 has a cylindrical shaped body having an outer portion that is fastened to the cup-shaped body 3 at an inner stepped portion of the cup shaped body 3.

The annular piston 6 being mobile between a first position and at least a second position, wherein in the first position the pressing member 80 is in a non-pressed state and wherein in the second position, the pressing member 80 is in a pressed state. In the first position as shown in FIG. 6, the annular piston 6 closes in a fluid-tight way, under the thrust of said spring 7, at least one hole 5*c* that traverses the thickness of the stem 5 in proximity of its first end 5*a* and opens into a cavity 5*d* of the stem 5. More particularly, said piston 6 bears in a fluid-tight way upon the widened end portion 5*a* of the stem 5 and closes said cavity 5*d* of the stem 5 and blocks the connection between said chamber 4 and the cavity 5*d* of the stem 5 itself.

In the second position, not shown, as the spring 7 is compressed by pressing the pressing member 80, the piston 6 is raised away from said at least one hole 5*c* of the stem 5 and from said widened end portion 5*a*, enabling the cosmetic product present in the chamber 4 to be dispensed by passing through said hole 5*c* and cavity 5*d* made in the stem 5.

Preferably, the stem 5 comprises at least one first hollow tubular element 12 and one second hollow tubular element 13, which are partially inserted into one another and have features for e.g. corresponding groove and protrusion designed to fasten them together. The first tubular element 12 extends at least partially on the outside of the cup-shaped body 3 and has the collar 5*b* for retaining the first end 7*a* of the spring 7. The second tubular element 13 presents the inlet hole 5*c* of the cavity 5*d* of the stem 5 and also comprises the widened end portion 5*a* for resting of the piston 6.

Further, the pump assembly 70 comprises a ring 17 disposed at least partially within a top part of the cup shaped body 3. The ring 17 has at least a protrusion on its outer surface that snap fits with a corresponding inner groove formed at the top part of the cup shaped body 3. The ring 17 having an inwardly projecting rim 17*b* for retention of the collar 5*b* of the stem 5, which is designed to prevent exit of the stem 5 from the cup shaped body 3 under the thrust of the spring 7.

The first hollow tubular element 12 of the stem 5 has, at its top mouth an annular groove 5*h* for snap coupling with the pressing member 80.

The spring 7, the piston 6, and the retaining element 14 have a through hole so that they can be fitted on the stem 5, see FIG. 6.

Additionally, the inner container 20 may not be made in a single piece and may comprise a tubular body whose lower end is closed by a separate bottom plate 26, as shown in FIGS. 2 and 6.

In order to assemble the refillable dispenser pump 100, the pushing plate 30 is inserted into the inner container 20, the cosmetic material is accommodated therein, and then the inner container 20 is coupled to the annular sleeve 60 of the dispenser head assembly 40 through corresponding screw means, the outer container 10 is then coupled with the lower end portion of the cap 50 of the dispenser head assembly 40 using J-lock means such that inner container 20 is received into the outer container 10.

In order to use the cosmetic container assembled in the above manner, the outer container 10 is held by one hand, the pressing member 80 is pressed so that it moves downward to actuate the pump assembly 70, and thus the cosmetic product is discharged to the outlet 81 for use.

It should be understood that the foregoing description is only illustrative of the present disclosure. Various alternatives and modifications can be devised by those skilled in the art without departing from the disclosure. Accordingly, the present disclosure is intended to embrace all such alternatives, modifications and variations that fall within the scope of the appended claims.

What is claimed is:

1. A refillable pump dispenser for dispensing a flowable cosmetic product comprising:

an outer container;

an inner container accommodating the flowable cosmetic product and configured to be inserted into the outer container;

a pushing plate inserted into an inner lower side of the inner container to push up the flowable cosmetic product;

a dispenser head assembly coupled with upper sides of both the outer container and the inner container;

wherein the outer container and the inner container are detachably connected to the dispenser head assembly;

wherein the inner container is replaceable;

wherein the dispenser head assembly includes a cap, a pump assembly, a pressing member, and an annular sleeve, wherein the annular sleeve comprises a central bore and wherein an inner surface of the central bore comprises threads configured to be removably engaged with corresponding threads formed on an outer surface of a neck of the inner container;

wherein the annular sleeve is designed to retain the pump assembly stably to the neck of the inner container and wherein the pump assembly is installed through the central bore of the annular sleeve;

wherein the annular sleeve and the pressing member are inserted inside the cap;

wherein the annular sleeve is fixedly coupled to the cap such that there is no relative motion between the annular sleeve and the cap;

wherein the inner container detaches from the annular sleeve when there is a relative rotation between the cap and the inner container;

wherein the outer container is removably coupled to the cap;

wherein the outer container detaches from the cap when the outer container is rotated with respect to the cap;

wherein the pump assembly comprises a cup-shaped body comprising an outer flange configured to be received in an inner groove present in the central bore of the annular sleeve for fixedly receiving the pump assembly in the central bore of the annular sleeve such that there is no relative motion between the cup-shaped body and the cap; and wherein the pressing member is coupled to an upper portion of the pump assembly and wherein the pressing member at one side thereof has an outlet through which the cosmetic product is discharged.

2. The refillable pump dispenser according to claim 1, wherein the annular sleeve comprises at least one protrusion on an outer surface thereof which fixedly couples with corresponding groove formed on an inner surface of the cap.

3. The refillable pump dispenser according to claim 1, wherein the cap includes a cylindrical body having open top and bottom ends and wherein the cylindrical body formed at one side thereof with an outlet revealing hole; and wherein the outlet of the pressing member protrudes out from the outlet revealing hole of the cap.

4. The refillable pump dispenser according to claim 1, wherein the outer container is formed at an upper portion thereof with an entrance and wherein at least one groove formed on an outer periphery of the entrance is detachably coupled with at least one protrusion formed at an inner surface of a lower end portion of a cylindrical body of the cap.

5. The refillable pump dispenser according to claim 4, wherein the at least one groove of the outer container is L or J shaped.

6. The refillable pump dispenser according to claim 1, wherein the pump assembly is designed to be fastened to a mouth of the inner container.

7. The refillable pump dispenser according to claim 1, wherein the pump assembly further comprises a hollow elongated stem, a spring, an annular fluid tight piston, a retaining element and a check valve.

8. The refillable pump dispenser according to claim 7, wherein the hollow elongated stem has, at its top mouth an annular groove for snap coupling with the pressing member.

9. The refillable pump dispenser according to claim 7, wherein the hollow elongated stem extends at least partially into the cup-shaped body and wherein the cup-shaped body delimits a chamber for suction/compression of the cosmetic product to be dispensed.

10. The refillable pump dispenser according to claim 9, wherein the chamber is delimited by a wall of the cup-shaped body; the check valve designed to close a hole for inlet of the cosmetic product to be dispensed into said chamber from the inner container; the annular piston; and a widened end portion of the hollow elongated stem.

11. The refillable pump dispenser according to claim 10, wherein the annular piston is slidable in a fluid-tight way on an inner surface of the chamber and on a lower end of the hollow elongated stem.

12. The refillable pump dispenser according to claim 7, wherein the spring has a top end which bears upon a projecting collar of the hollow elongated stem, which is made of a single piece with the stem at an upper end portion of said stem.

13. The refillable pump dispenser according to claim 12, wherein the retaining element retains a bottom end of the spring.

14. The refillable pump dispenser according to claim 11, wherein the annular piston being mobile between a first position and a second position, wherein in the first position the pressing member is in a non-pressed state and wherein in the second position the pressing member is in a pressed state.

15. The refillable pump dispenser according to claim 14, wherein when the pressing member is not pressed, the annular piston closes in a fluid-tight way, under the thrust of said spring, at least one hole traversing a thickness of the hollow elongated stem in proximity of its first end and opens into a cavity of the stem.

16. The refillable pump dispenser according to claim 15, wherein the annular piston bears in a fluid-tight way upon the widened end portion of the hollow elongated stem and closes the cavity of the stem and blocks a connection between the chamber and the cavity of the stem itself.

17. The refillable pump dispenser according to claim 14, wherein when the pressing member is pressed, the spring is compressed and the annular piston is raised away from at least one hole of the hollow elongated stem and from the widened end portion, enabling the cosmetic product present in the chamber to be dispensed by passing through the hole and the cavity of the hollow elongated stem.

18. The refillable pump dispenser according to claim 7, wherein the stem comprises at least one first hollow tubular element and one second hollow tubular element partially inserted into one another, wherein the first tubular element extends at least partially on an outside of the cup-shaped body and has a collar for retaining a first end of the spring.

19. The refillable pump dispenser according to claim 1, wherein the cup-shaped body passes through the central bore of the annular sleeve and extends away from the annular sleeve toward the cap.

* * * * *